US007322894B2

(12) United States Patent
Darmohusodo et al.

(10) Patent No.: US 7,322,894 B2
(45) Date of Patent: Jan. 29, 2008

(54) APPARATUS AND METHOD FOR TENNIS SWING TRAINING

(76) Inventors: Vincent Darmohusodo, 4178 Decoro St., #44, San Diego, CA (US) 92122; Joseph Cohen, 11099 N. Torrey Pines Rd., #160, La Jolla, CA (US) 92037

( * ) Notice: Subject to any disclaimer, the term of this patent is extended or adjusted under 35 U.S.C. 154(b) by 9 days.

(21) Appl. No.: 11/479,911

(22) Filed: Jun. 29, 2006

(65) Prior Publication Data

US 2007/0004540 A1 Jan. 4, 2007

Related U.S. Application Data

(60) Provisional application No. 60/695,125, filed on Jun. 30, 2005.

(51) Int. Cl.
*A63B 69/38* (2006.01)

(52) U.S. Cl. ..... 473/464; 473/459; 473/553

(58) Field of Classification Search ..... 473/459, 473/464, 461, 553, 549, 551
See application file for complete search history.

(56) References Cited

U.S. PATENT DOCUMENTS

| | | | | |
|---|---|---|---|---|
| 3,858,881 | A * | 1/1975 | Hurwitz | 473/553 |
| 4,209,169 | A * | 6/1980 | Roberts | 473/464 |
| 4,445,686 | A * | 5/1984 | Daugherty | 473/464 |
| 4,720,106 | A * | 1/1988 | Bickham | 473/521 |
| 2007/0004540 | A1 * | 1/2007 | Darmohusodo et al. | 473/464 |
| 2007/0191146 | A1 * | 8/2007 | Darmohusodo et al. | 473/464 |

* cited by examiner

*Primary Examiner*—Raleigh W. Chiu
(74) *Attorney, Agent, or Firm*—Donn K. Harms

(57) ABSTRACT

A racket grip training apparatus providing user chosen static positioning of a tennis racket in the hand at angles to the forearm that are determinable and repeatable. The device further provides components to set the face angle of the racket engaged to the device and visual indica to allow for the same positioning in subsequent uses. A planar member is removably engageable to the user's forearm at a first end and has an aperture at an opposite end adapted to encircle the grip of a racket and sized to prevent rotation of the racket axis past predetermined limits relative to the axis of the planar member.

21 Claims, 2 Drawing Sheets

APPARATUS AND METHOD FOR TENNIS SWING TRAINING

This application claims priority from U.S. Provisional Patent Application Ser. No. 60/695,125 filed Jun. 30, 2005.

FIELD OF THE INVENTION

The invention herein disclosed relates to sports which employ a racket or club to continuously strike a ball. More particularly, it relates to the sports of golf which employs a club and especially tennis in which a racket is used by participants to strike a tennis ball. Further, it relates to a device and method for instruction and practice of proper racket gripping and swinging, through the provision of an arm-engageable bracket member adapted for encirclement of the base end of a tennis racket when the racket is in the as-gripped position in the hand of a tennis player. The device is also adapted for adjustment of its engagement with a racket grip to allow for smaller and larger racket grips, thereby providing for use by both children and adults. The preferred embodiments herein relate to tennis; however, those skilled in the art will realize the device can be employed for golf swing training and such is anticipated.

BACKGROUND OF THE INVENTION

Tennis is a sport that has become ever more popular throughout the world. This is especially true with the many tournaments that are televised featuring world class players peaking the interest of new and old players worldwide. Additionally tennis is in the realm of "carry over" sports which means that both children and adults may play the game and once learned as a child, the sport can carry over to their adulthood for exercise and entertainment.

The proper tennis racket swing is a controlled kinetic chain of events starting with the feet pushing down on the ground and a transfer of energy through the legs, hips, swinging arm, racket, and ball in that respective order. The tennis racket is essentially an extension of the hitting arm, where both of them must work as one unit. This proper swing technique engages the largest muscles in the body for power as well as a minimal amount of swing variance to ensure control.

However, this proper swing technique requires a greater amount of energy to execute than a variety of improper, less accurate techniques. Therefore, the majority of beginner to intermediate tennis players will default to using these lower energy improper swings during play. It is extremely challenging to instruct players to use the proper swing technique when they can use less energy to hit the ball using an improper swing. Without constant guidance and instruction, most tennis players will not develop the proper swing technique as long as the lower energy improper swing is available.

Improper swing techniques usually all stem from using the wrist to generate power. When this occurs, the tennis racket and the hitting arm do not work together as a unit anymore. By using the wrist the player does not have to move their legs and body as much and they can still make contact with the ball. Because the wrist has such a wide range of motion it does not even come close to providing the level of consistency needed to advance a player past the intermediate level. Further, the wrist alone can never provide the level of power that is generated by the proper swing technique.

Further, it is difficult for instructors to verbally instruct players to visualize and execute the proper swinging technique. This is generally because the player is usually focused on hitting a ball over the net rather than listening to the spoken words of the instructor. The player by default will execute their swing using the wrist. Even players who are attempting to improve will tend to focus too much on the proper swinging technique and thereby become bogged down in thought and have trouble even making contact with the ball.

As such, there is a pressing need for a device and method which a player may employ themselves that will ensure that proper swinging technique with out need for concurrent verbal instructions. Such device will help players maintain the position of their hand relative to the forearm, thereby helping eliminate the use of their wrist to generate power. Such device will inherently eliminate the player's reliance on the improper swing technique which naturally leaves the proper swing technique as the only option available. Further, such a device should allow the player to focus on hitting the ball rather than trying to follow instructions. Finally, such device should allow the user to create muscle memory during practice sessions over time so that the player will eventually use the proper swing technique once the device is removed.

Additionally, such a device should be easily adjustable to different racket sizes and provide visual means to ascertain the angle of the racket axis relative to the forearm so that a player may determine the best angle for them and be able to repeat positioning of their racket during subsequent sessions by employing the visual cue.

With respect to the above description, before explaining at least one preferred embodiment of the invention in detail, it is to be understood that the invention is not limited in its application to the details of construction and to the arrangement of the components or steps set forth in the following description or illustrated in the drawings. The various apparatus and methods of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

Therefore, those skilled in the art will appreciate that the conception upon which this disclosure is based may readily be utilized as a basis for designing of other devices, methods and systems for carrying out the several purposes of the present disclosed device. It is important, therefore, that the objects and claims be regarded as including such equivalent construction and methodology insofar as they do not depart from the spirit and scope of the present invention.

Further objectives of this invention will be brought out in the following part of the specification wherein detailed description is for the purpose of fully disclosing the invention without placing limitations thereon.

SUMMARY OF THE INVENTION

The device and method of employment herein disclosed and described provides for easy engagement to the arm of a player and components adapted to engage the base of a tennis racket with visual positioning cues to allow for repeatable angled positioning of the racket during practice and play.

The device herein disclosed and described enables multiple grip formats for different modes of practice and play.

One component is adapted to prevent improper wrist breaks or rotation toward the lower forearm, yet still allows correct wrist flexibility. Another provided component allows for proper angling of the racket relative to the forearm and visual reference points to allow the user to ascertain their best angle and thereafter repeat it during practice and play. The combination of functional components additionally provides quick results in the accurate and proper positioning of the racket for a swing, thereby allowing practice sessions and play that create muscle memory which the player will remember long after use of the device may have ceased.

The device employs a planar elongated member which is adapted at a first end for removable engagement to the forearm of the user. Straps with fasteners or hook and loop fastening fabric provide an easy and adjustable means for engagement of the first end of the member forming the device to the forearm. At a second end of the planar member is located an aperture communicating therethrough adapted for encirclement of the grip of a tennis racket or in the case of golf, a golf club grip. As noted this disclosure is primarily directed at engagement of a tennis racket; however, those skilled in the art will realize the device may also be employed with a golf club to provide correct club angles and prevent wrist rotation to impart muscle memory, and such is anticipated within the scope of this patent.

The aperture which surrounds the grip of a tennis racket is sized to prevent rotation of the racket where the axis is outside a desired range which in the current mode is between 90 to 130 degrees of angle of the racket axis to arm axis. The aperture may be any shape that provides this desired engagement and a current particularly preferred mode of the device employs a round aperture. This is because the round aperture allows for the rotatable mounting of a plastic or rubber grommet inside the aperture which can be adapted to provide other adjustable means for setting and maintaining racket angle.

Indica positioned on the top surface of the planar member surrounding the aperture provides a visual means to determine a preferred grip position which determines a corresponding preferred angle of the face of the racket. Different grip positions with corresponding different preferred face angles allow a player to generate different spins to the ball, and the indicia provides a visual means to repeat the same chosen preferred angle at subsequent practice sessions by aligning the racket with the same indicia chosen at the last practice session.

Finally an optional slidable ring attachment to the racket handle provides a means for the user to determine a position along the racket axis for gripping the racket and repeating that grip point in substantially the same position at later sessions. The frictionally or elastically engaged ring would be slid a desired distance from the distal end of the racket grip to prevent the grip from sliding through the aperture of the member. The user thus determines a point on the racket for their grip when the planar member is engaged to the arm and can repeat that positioning subsequently by sliding the ring to the same position after engaging the racket in the aperture.

Finally, the grommet can also be provided with a physical means to maintain the racket at a determined angle by positioning a racket engaging slot about an edge. The slot can be rotated by rotating the grommet and positioned using the indicia on the member to a determined desired point. The racket grip in the slot will be maintained during use, and the positioning is repeatable in subsequent sessions by the same grommet rotation and positioning.

The device thus provides for proper repeatable positioning of the racket in an as-gripped position in the user's hand and supports that position during use thereby providing an easy way for the player to learn muscle memory and eventually cease using the device. The racket practice device is designed to enable players to hit all kinds of shots from flat, topspin, or underspin. It allows players to swing with different grips, one hand and two hand backhand, and forehand and backhand volleys.

An object of this invention is to provide a tennis or golf club practice aid that is easily engaged to the arm of the user and provides proper positioning of the racket or club during practice and play.

Another object of this invention is to provide such a practice aid that helps prevent wrist rotation toward and away from the bottom of the forearm to aid in learning proper wrist maintainment during play.

A further object of this invention is to help prevent players from executing improper racket strokes.

An additional object of this invention is the provision of such a practice device that provides for easy determination and maintenance of a preferred angle of the racket axis relative to the arm axis when gripped by the hand.

A still further object of this invention is the provision of such a mean to determine racket angle that employs visual cues and thereby is repeatable during subsequent use.

Yet another object of this invention is the provision of a means to determine a grip point on the racket grip for the hand, and allow the grip point to be maintained and repeated during subsequent use.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE ASSOCIATED DRAWINGS

DETAILED DESCRIPTION OF PREFERRED EMBODIMENTS OF THE DISCLOSED DEVICE

Figure 1:
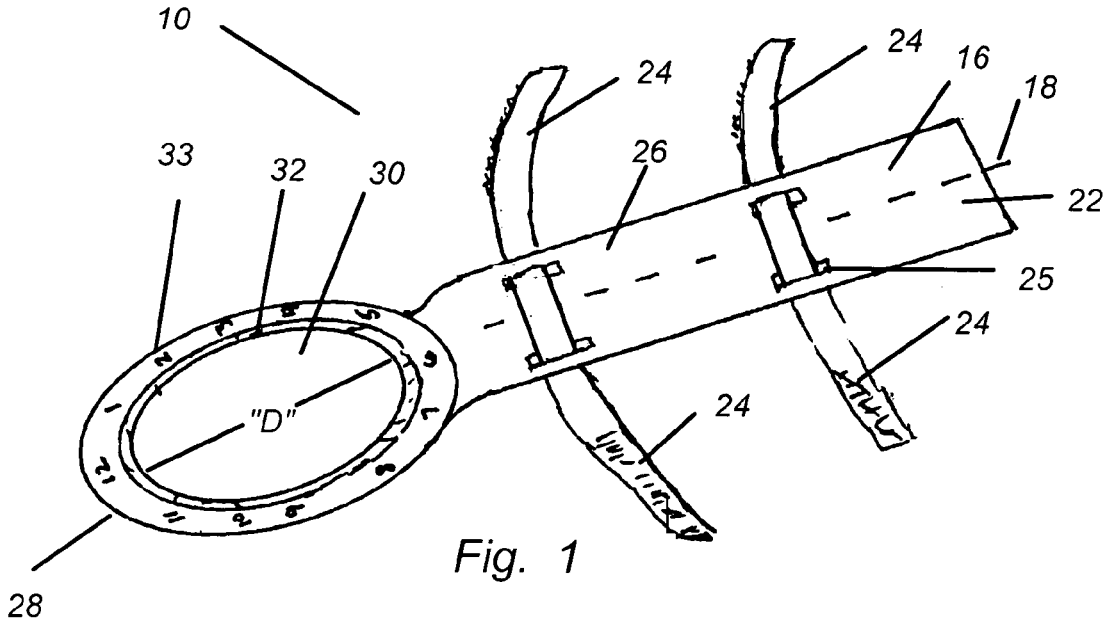
FIG. 1 is a top perspective view of the device showing the elongated member adapted for removable engagement to the arm of the user at one end and removable engagement around the grip of a racket at the other end.
Figure 2:
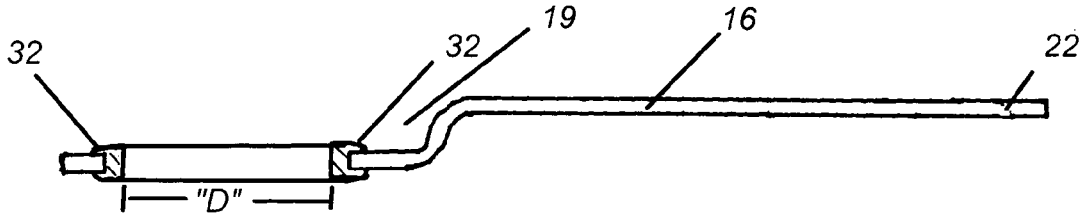
FIG. 2 depicts a sliced side view of FIG. 1 showing a preferred mode of the device with the second end of the planar member slightly out of plane with the first end providing a means to accommodate the bottom of the wrist during use.

Referring now to the drawings, FIGS. 1-5 disclose the preferred embodiments of the disclosed racket grip training device 10 in a form adapted for removable engagement with the grip end 12 of a tennis racket 14.

Figure 4:
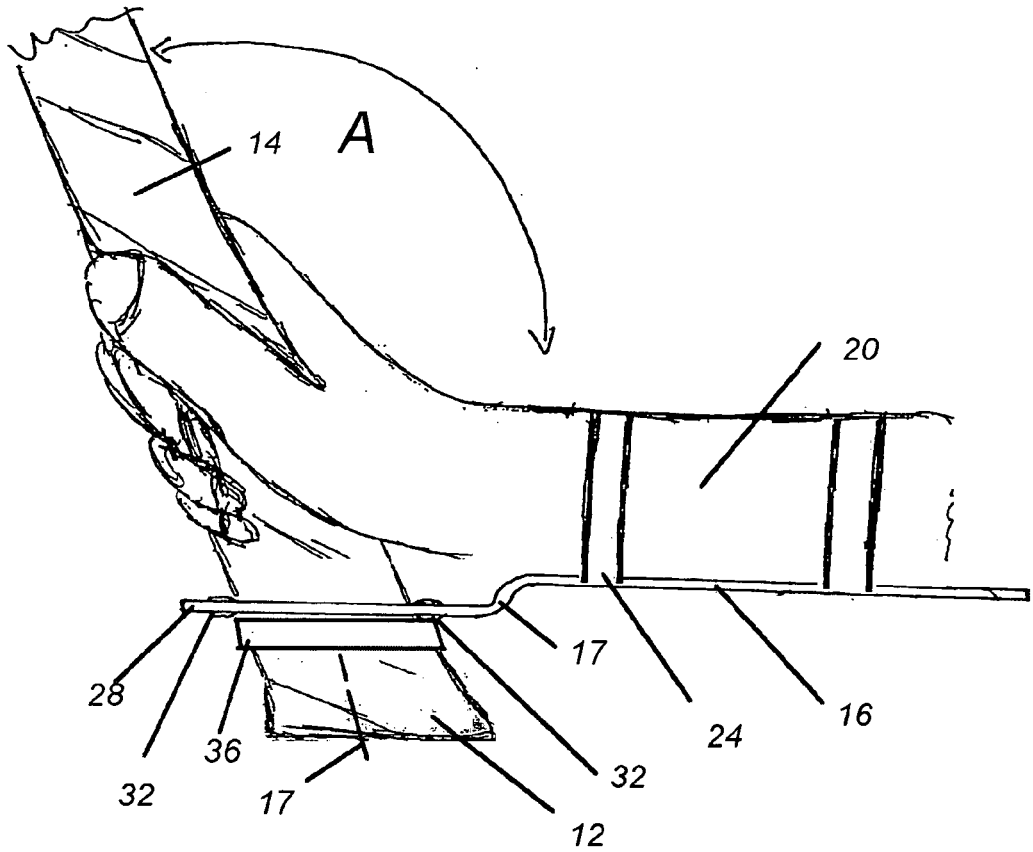
FIG. 4 depicts a perspective view of the device in the as-worn position engaged to the distal end of a racket grip.
Figure 5:
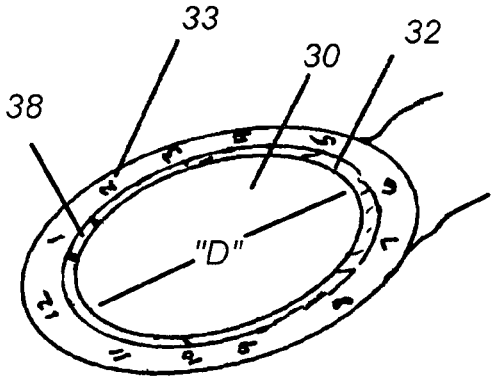
FIG. 5 depicts a perspective view of the second end of the device and the aperture communicating therethrough for engagement of the racket. A grommet is mounted in the aperture which is surrounded by indicia.

The device 10 is formed in an elongated planar member 16 having an axis 18 therethrough which generally parallels an axis of the user's forearm 20 when removably engaged to the forearm 20 in the as-worn position shown in FIG. 4. A first end 22 of the planar member 16 is adapted for removable engagement to the forearm 20 of a user employing means of engagement such as strap fasteners 24 formed of hook and loop style fabric engaged through slots 25. Of course other shapes of the planar member 16 such as a curve around the axis 18 could be employed and are anticipated. Further, other means to engage the strap fasteners 24 might be employed such as buckles or clips and the means of engagement of the first end 22 to the forearm 20 could be a sleeve or any other means to removably hold the top surface 26 of the planar member 16 against the forearm 20 during use, and all such means to engaged the planar member 16 comfortably to the forearm as would occur to those skilled in the art are anticipated in the scope of this invention.

Figure 3:
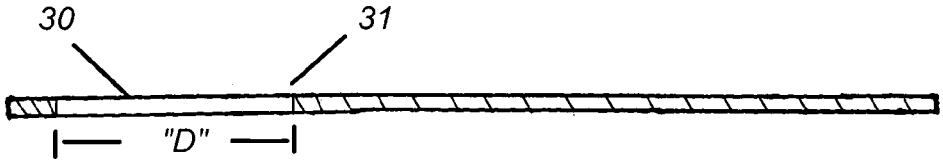
FIG. 3 depicts a side sliced view of the device showing an inline relationship of the first end and second end of the elongated member in another embodiment of the device and the aperture communicating through the second end of all embodiments.

A second end 28 of the planar member 16 is adapted to encircle the grip end 12 of the racket 14 during use thereby providing means for removable engagement around the racket grip 16. An aperture 30 defined by an aperture side edge 31 as shown in FIG. 3 which is the simplest mode of the device 10, communicates through the planar member 16 and is provided for this purpose. The aperture 30 is sized to encircle the grip end 12 and an allow it to tilt a limited amount before preventing additional tilt which provides a means to maintain it at a predetermined angle "A" to the axis 18 during a stroke of the racket 14. Depending on the diameter of the grip end 12, the appropriate sized diameter of the aperture "D" would be used to maintain the angle A during use since the two side edges of the grip end 12 are prevented from moving by the sides of the aperture 30 when the racket rotates to a maximum desired angle. Currently, it has been determined that a desired range of the angle A for training of the user is between 90 to 130 degrees of angle of the racket axis 17 to axis 18.

An angled or curved portion 17 of the planar member 16 is positioned to place the top surface 26 at the second end 28 slightly spaced apart from the top surface 26 at the first end 22 and thereby provide a space 19 above the second end 28 as a means to accommodate the projecting curve of the hand where the palm meets the wrist making the device 10 more comfortable when worn. While the device would function without this spacing, as shown in FIG. 3, experimentation has found that it makes it much more comfortable to wear especially for long periods of time and it is consequently preferred.

The aperture 30 may be any shape that provides this desired engagement to maintain the angle A during use such as an oval or a shape having angled sides parallel to those of the racket side edges. In a particularly preferred mode of the device 10 the aperture 30 is round and within it is engaged a grommet 32. The grommet 32 can be provided in a kit of grommets 32 having different diameters "D" of the apertures communicating through the grommet 32. The outside circumference of the grommet 32 would be adapted to engage the side edge 31 defining the aperture 30. Each member of the kit of grommets 32 can have a different sized diameter D thereby providing the user a means to vary the size of the inside diameter D of the aperture 30 communicating through the planar member 16 by inserting grommets 32 from the kit having different sized apertures. The grommets 32 would best be color coded or otherwise visually marked with indicia to provide the user information as to the size of their diameter D. In this fashion the user can choose a grommet 32 with an appropriate sized diameter D to achieve the desired angle A of the racket during use of the device 10. Use of removably engageable grommets 32 and the availability of different sized diameters D communicating therethrough, provides the user an easy way to change the angle A of their racket during use of the device 10 and to experiment and maintain that angle once the best one for that particular user is found.

A visual means to determine a proper face angle of the racket 14 depending on the type or style of hand grip employed by the user is provided by indica 33 positioned on the top surface 26 of the planar member 16 in positions surrounding the aperture 30 or grommet 32. Two such styles include the Eastern Grip and the Continental Grip and involve how the fingers and thumb of the user wrap around the grip end 12 of the racket 14. Different areas of the world teach these different grip styles so the device 10 provides a means to determine a desired racket face angle using the indicia 33 once the user has assumed their favored grip of the racket 12.

For example, if the user employs the Continental Grip with the device engaged in the as-used position with the grip end 12 traverse to the axis 18 and communicating through the appropriate diameter D of aperture 30, they would position the racket 14 so that a side edge is aligned with the number 12 of the indicia 33. If this works well for them, they would simply repeat this position. If it does not, they would choose a different alignment such as the indica points "11" or "1". Whatever point is chosen, it is subsequently easily repeatable. Should the user be used to the Eastern Forehand Grip alignment with indica 33 at the "13" point may be preferred by may also be adjusted until their swing works best. As such, the device 10, using indicia 33 or other means to designate points around the aperture 30 provides a means to determine the angle of rotation of the racket 14 to achieve the desired face angle for their individual style and repeat it in subsequent sessions by placing the leading side edge of the grip end 12 at the chosen designated point.

In another preferred mode of the device 10, there is also provided a ring 36 which is frictionally engageable on the grip end 12 of the racket 14 through an aperture in the ring 36. The outside circumference of the ring 36 is sized slightly larger than aperture diameter D communicating through the planar member 16 which prevents the distal end of the grip end 12 from sliding through the aperture 30 once inserted therein and the ring 36 attached. The ring would work well if made of elastic material that naturally grips the racket grip 12. Thus engaged, the ring 36 provides a means to determine a gripping position for the hand along the racket axis 17 and the distance the racket head extends from the hand. The distance of extension can be adjusted by sliding the ring to a different location along the racket axis 17. The user thus determines a point on the racket 14 for their grip which works best and can repeat that point by subsequent placement of the ring 36 the same distance from the distal end of the grip end 12 in subsequent sessions.

In another mode of the device 10 which may appeal to users who need glasses or do not wish to employ the indica 33 for racket head angling, the grommet 32 is provided with a physical means to maintain the racket at a determined face angle around the racket axis 17 through the provision of a slot 38 about the edge of the grommet 32 adapted to engage a side edge of the grip end 12. The grommet 32 would be rotatable in its engagement with the side edge 31 in the member 16 and the slot 38 would be rotated by rotating the grommet 32. The user can as such determine a desired face angle of the head of the racket and rotate the grommet 32 and slot 38 to achieve that angle when using their preferred grip style. The angle chosen for their grip is easily repeatable in subsequent sessions by rotation of the slot 38 to the same position.

The device 10 as such also provides a method for users to self instruct as to their swing of the racket 14 and maintaining the racket in the same position for all the swings and in multiple sessions. This would be done by attaching the device 10 to the forearm, by positioning the racket 14 in the correctly diametered aperture 30 to achieve a desired racket axis angle relative to the forearm, positioning the face angle of the racket to a desired face angle by rotating a point or surface of the grip end 12 to alignment with an indicia point determined to work best, and hitting the ball repeatedly. The device by maintaining the correct angles and preventing wrist rotation maintains the racket in the correct position and muscle memory will ensue after repeated sessions.

Although the invention has been described with respect to particular embodiments thereof, it should be realized that various changes and modifications may be made therein without departing from the spirit and scope of the invention. While the invention as shown in the drawings and described in detail herein discloses arrangements of elements of particular construction and configuration for illustrating preferred embodiments of structure and method of operation of the present invention, it is to be understood, however, that elements of different construction and configuration and other arrangements thereof, other than those illustrated and described, may be employed in accordance with the spirit of this invention. Any and all such changes, alternations and modifications as would occur to those skilled in the art are considered to be within the scope of this invention as broadly defined in the appended claims.

Further, the purpose of the attached abstract is to enable the U.S. Patent and Trademark Office and the public generally and especially the scientists, engineers and practitioners in the art who are not familiar with patent or legal terms or phraseology to determine quickly from a cursory inspection the nature and essence of the technical disclosure of the application. The abstract is neither intended to define the invention of the application which is measured by the claims, nor is it intended to be limiting as to the scope of the invention in any way.

What is claimed is:

1. A tennis swing training apparatus comprising:

an elongated member having a top surface and having a first end portion and a second end portion;

a center axis running through said member;

means of engagement of said first end portion to the forearm of a user in an as-worn position;

a member aperture defined by a side edge said member aperture communicating through said member at said second end portion, said member aperture having a diameter;

said diameter of said member aperture adapted for a contact of said side edge with two opposing sides of a tennis racket grip end in an angled engagement of said tennis racket therein; and said member aperture in said contact thereby providing means for restriction of said angled engagement to an engagement angle of a central axis of said tennis racket relative to said center axis, said engagement angle being between a minimum angle and maximum angle.

2. The tennis swing training apparatus of claim 1 additionally comprising:

said racket in said angled engagement in said as-worn position, providing means to restrict wrist rotation of said user when gripped by said user.

3. The tennis swing training apparatus of claim 2 additionally comprising:

means to vary said member aperture diameter and thereby vary said engagement angle, whereby a user can adjust said engagement angle to personal preference.

4. The tennis swing training apparatus of claim 3 wherein said means to vary said member aperture diameter and thereby vary said engagement angle comprises:

a grommet having an exterior circumference adapted for engagement within said sidewall;

said grommet having a grommet aperture communicating therethrough having a grommet aperture diameter;

said grommet having a mounted position with said circumference engaged with said sidewall; and said grommet aperture diameter defining said member aperture diameter when said grommet is in said mounted position, whereby a user can adjust said engagement angle to personal diameter.

5. The tennis swing training apparatus of claim 4 further comprising:

said grommet being rotatable in said member aperture;

said grommet having a groove adapted for and insertable engagement of one of said two opposing sides of said racket grip;

rotation of said grommet with said racket grip in said insertable engagement providing means for user determination of a preferred racket head angle of said racket head engaged at the opposite end of said racket from said grip end.

6. The tennis swing training apparatus of claim 4 further comprising:

a ring member having an internal aperture and an external circumference;

said internal aperture adapted for removable engagement upon said grip end; and said external circumference being larger than said member aperture; whereby said ring member when engaged to said racket grip prevents raising a portion of said grip end above said top surface of said member aperture thereby determining a distance of said racket face from said hand.

7. The tennis swing training apparatus of claim 3 further comprising:

indicia upon said top surface adjacent to said member aperture;

said indica proving visual means for user determination of a preferred racket head angle of said racket head engaged at the opposite end of said racket from said grip end.

8. The tennis swing training apparatus of claim 2 further comprising:

indicia upon said top surface adjacent to said member aperture;

said indica proving visual means for user determination of a preferred racket head angle of said racket head engaged at the opposite end of said racket from said grip end.

9. The tennis swing training apparatus of claim 1 additionally comprising:

means to vary said member aperture diameter and thereby vary said engagement angle, whereby a user can adjust said engagement angle to personal preference.

10. The tennis swing training apparatus of claim 9 wherein said means to vary said member aperture diameter and thereby vary said engagement angle comprises:

a grommet having an exterior circumference adapted for engagement within said sidewall;

said grommet having a grommet aperture communicating therethrough having a grommet aperture diameter;

said grommet having a mounted position with said circumference engaged with said sidewall; and said grommet aperture diameter defining said member diameter when said grommet is in said mounted position.

11. The tennis swing training apparatus of claim 10 wherein said grommet one of a kit of said grommets, said kit having other said grommets with different sized grommet apertures, whereby said member aperture diameter may be changed by engaging another one of said kit of said grommets having a different said grommet diameter.

12. The tennis swing training apparatus of claim 11 further comprising:

said grommet being rotatable in said member aperture;

said grommet having a groove adapted for and insertable engagement of one of said two opposing sides of said racket grip;

rotation of said grommet with said racket grip in said insertable engagement providing means for user determination of a preferred racket head angle of said racket head engaged at the opposite end of said racket from said grip end.

13. The tennis swing training apparatus of claim 10 wherein said grommet one of a kit of said grommets, said kit having other said grommets with different sized grommet apertures, whereby said member aperture diameter may be changed by engaging another one of said kit of said grommets having a different said grommet diameter.

14. The tennis swing training apparatus of claim 10 further comprising:

indicia upon said top surface adjacent to said member aperture;

said indica proving visual means for user determination of a preferred racket head angle of said racket head engaged at the opposite end of said racket from said grip end.

15. The tennis swing training apparatus of claim 10 further comprising:

an angled connection of said first end and second end of said elongated member;

said angled connection positioning said top surface of said second end a distance from said top surface of said first end; and said distance defining a recess above said second end, said recess adapted to accommodate the curve of an edge of the hand of said user when said elongated member is in said as-worn position.

16. The tennis swing training apparatus of claim 9 further comprising:

indicia upon said top surface adjacent to said member aperture;

said indica proving visual means for user determination of a preferred racket head angle of said racket head engaged at the opposite end of said racket from said grip end.

17. The tennis swing training apparatus of claim 16 further comprising:

said engagement angle being between 90 to 130 degrees.

18. The tennis swing training apparatus of claim 1 further comprising:

indicia upon said top surface adjacent to said member aperture;

said indica proving visual means for user determination of a preferred racket head angle of said racket head engaged at the opposite end of said racket from said grip end.

19. The tennis swing training apparatus of claim 1 further comprising:

a ring member having an internal aperture and an external circumference;

said internal aperture adapted for removable engagement upon said grip end; and said external circumference being larger than said member aperture, whereby said ring member when engaged to said racket grip prevents raising a portion of said grip end above said top surface of said member aperture thereby determining a distance of said racket face from said hand.

20. The tennis swing training apparatus of claim 19 further comprising:

an angled connection of said first end and second end of said elongated member;

said angled connection positioning said top surface of said second end a distance from said top surface of said first end; and said distance defining a recess above said second end, said recess adapted to accommodate the curve of an edge of the hand of said user when said elongated member is in said as-worn position.

21. The tennis swing training apparatus of claim 1 further comprising:

an angled connection of said first end and second end of said elongated member;

said angled connection positioning said top surface of said second end a distance from said top surface of said first end; and said distance defining a recess above said second end, said recess adapted to accommodate the curve of an edge of the hand of said user when said elongated member is in said as-worn position.

* * * * *